US005159394A

United States Patent [19]

Jinzai

[11] Patent Number: 5,159,394

[45] Date of Patent: Oct. 27, 1992

[54] IMAGE FORMING APPARATUS AND FIXING DEVICE

[75] Inventor: Makoto Jinzai, Yokohama, Japan

[73] Assignee: Canon Kabushiki Kaisha, Tokyo, Japan

[21] Appl. No.: 711,060

[22] Filed: Jun. 6, 1991

[30] Foreign Application Priority Data

Jun. 8, 1990 [JP] Japan ..... 2-148798
Jun. 3, 1991 [JP] Japan ..... 3-131201

[51] Int. Cl.[5] ..... G03G 15/20
[52] U.S. Cl. ..... 355/290; 355/284
[58] Field of Search ..... 219/10.57, 216; 355/285, 289, 290, 282

[56] References Cited

U.S. PATENT DOCUMENTS 4,596,920 6/1986 Inagaki ..... 219/216
4,829,931 5/1989 Mogi ..... 355/289 X
4,935,785 6/1990 Wildi et al. ..... 355/290

FOREIGN PATENT DOCUMENTS 61-91677 5/1986 Japan ..... 355/290

*Primary Examiner*—A. T. Grimley
*Assistant Examiner*—P. J. Stanzione
*Attorney, Agent, or Firm*—Fitzpatrick, Cella, Harper & Scinto

[57] ABSTRACT

An image forming apparatus for forming a toner image on a recording material applies a bias voltage having the same polarity as the toner to a core bar of a fixing roller. A fixing entrance guide is provided so that the recording material approaches or contacts the fixing roller when the recording material enters a contact-pressure region formed by the fixing roller and a pressing roller. Thus, offset of toner to the fixing roller is prevented.

31 Claims, 6 Drawing Sheets

IMAGE FORMING APPARATUS AND FIXING DEVICE

BACKGROUND OF THE INVENTION

1. Field of the Invention

This invention relates to an image forming apparatus, such as an electrophotographic copier, a printer or the like.

2. Description of the Related Art

In a conventional image forming apparatus, a toner image is formed on an image bearing member (for example, a photosensitive member) using an electrophotographic method or the like. The toner image is then transferred to a recording material in order to form an unfixed toner image thereon and the recording material is passed through a fixing device, comprising a fixing roller, a pressing roller and the like, to fix the toner image on the recording material.

In order to prevent so-called offset wherein toner adheres to the fixing roller, some fixing devices are provided with a surface releasing layer comprising fluororesin (for example, PFA, PTFE) or the like, coating the fixing roller. By coating the surface releasing layer on the fixing roller, offset of toner to the fixing roller due to a pressing force can be prevented.

However, the surface releasing layer comprising fluororesin or the like may generate triboelectric charges in the recording material so as to result in electrostatically-produced offset. More specifically, when a recording material bearing toner is charged to a positive polarity and a surface releasing layer generates triboelectric charges, the surface releasing layer becomes charged to a negative polarity. As a result, the surface releasing layer and the toner achieve opposite polarities and attract each other so as to result in electrostatically-produced offset.

In order to overcome this problem, a conductive substance may be incorporated within the surface releasing layer in order to reduce the potential of the surface of the fixing roller. Although using greater amounts of conductive substances effectively reduces the potential of the fixing roller surface and reduces the effect of electrostatic offset, the large amounts of conductive substance which is required reduces the releasability of the fixing roller surface, thereby enhancing pressure-generated offset.

In copending U.S. patent application Ser. No. 618,399 (filed Nov. 27, 1990), the assignee of the present application has proposed a method of positively preventing toner offset by applying a bias voltage to a core bar of a fixing roller in order to form a repulsive electric field between the surface of the fixing roller and toner. In this method, however, when a recording material enters a pressure-contact region, formed by the fixing roller and a pressing roller, in a state wherein the fixing roller and the recording material are greatly separated, offset could not be effectively prevented.

SUMMARY OF THE INVENTION

It is an object of the present invention to prevent electrostatic offset of an unfixed toner image to a fixing roller.

It is another object of the present invention to provide an image forming apparatus, comprising a fixing roller comprising a conductive base member and a surface releasing layer, a pressing roller in pressure contact with the fixing roller, and a guide unit for guiding a recording material in a pressure-contact region formed by the fixing roller and the pressing roller. The apparatus comprises a power supply for applying a bias voltage to a core bar of the fixing roller. A first plane is defined as passing through the longitudinal axes of the rollers and the pressure-contact region, and a second plane is defined as being substantially perpendicular to the first plane and passing through the pressure-contact region. A first portion of a guide unit, in the guiding direction of the recording material which is closer to the fixing roller is disposed on the same side of the second plane as the fixing roller.

It is still another object of the present invention to provide a fixing device, comprising a fixing roller comprising a conductive base member and a surface releasing layer, and a pressing roller in pressure contact with the fixing roller. The device comprises a power supply for applying a bias voltage to the conductive base member, and a recording material enters a pressure-contact region formed by the fixing roller and the pressing roller after contacting the fixing roller.

These and other objects of the present invention will become more apparent from the following detailed description taken in connection with the accompanying drawings.

DETAILED DESCRIPTION OF THE PREFERRED EMBODIMENTS

Figure 1:
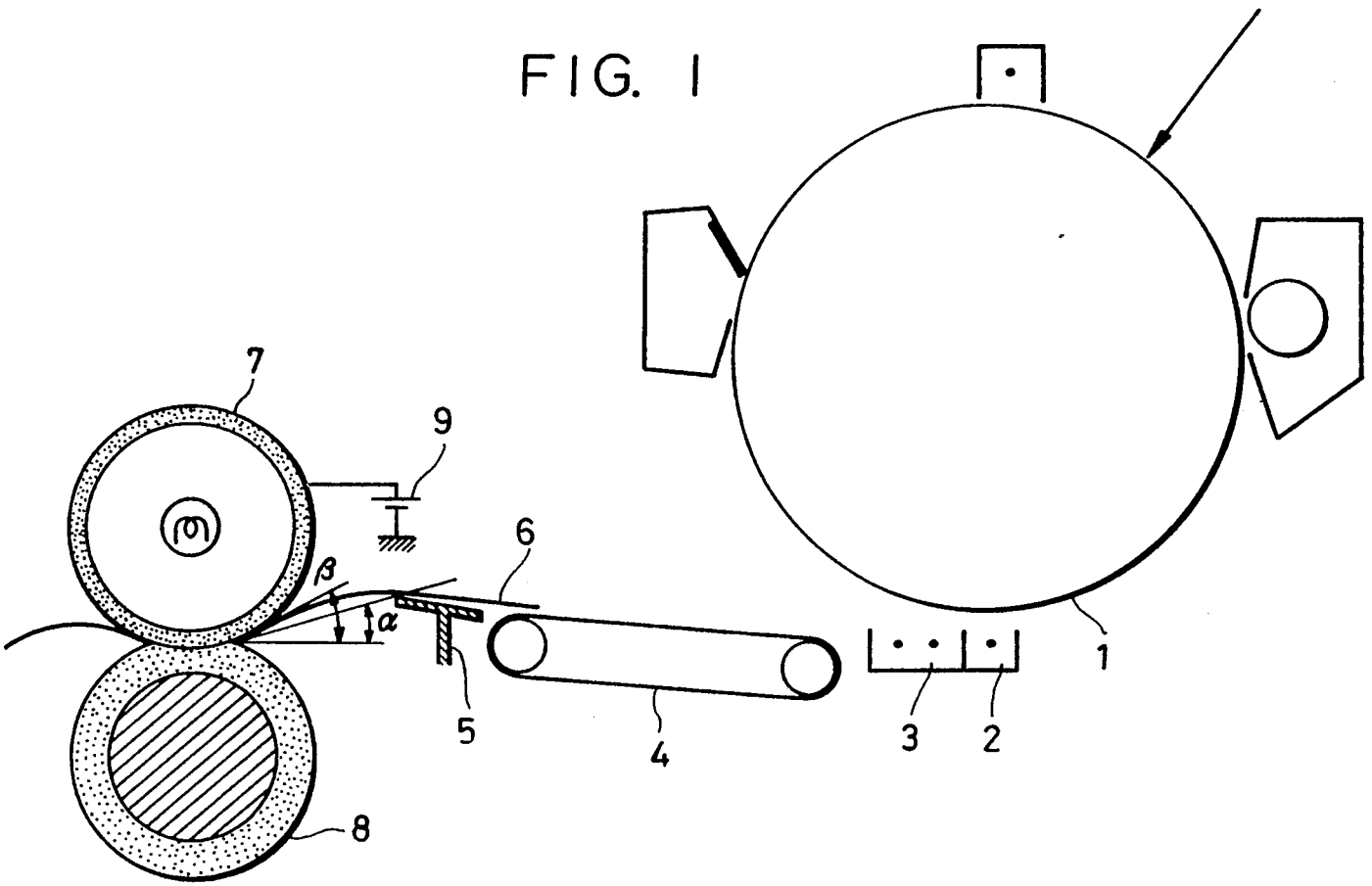
FIG. 1 is a schematic cross-sectional view of an image forming apparatus according to a first embodiment of the present invention.

FIG. 1 is a cross-sectional view of an image forming apparatus according to a first embodiment of the present invention. In FIG. 1, a toner image formed on the surface 1 aye r of a photosensitive member 1, u sing an electrophotographic process, is transferred onto a recording material 6 at a transfer region by a transfer charging unit 2. The transfer region is a region wherein the photosensitive member 1 and the charging unit 2 face each other. After the toner image is transferred at the transfer region, and the recording material 6 is separated from the photosensitive member 1 by a separation charging unit 3, the recording material is then conveyed by a conveying belt 4 through an entrance guide 5. After passing through the entrance guide 5, the recording material enters a pressure-contact region formed by a fixing roller 7 having a heating source and a pressing roller 8. The recording material is fixed at the pressure-contact region by the function of heat and pressure.

Figure 2:
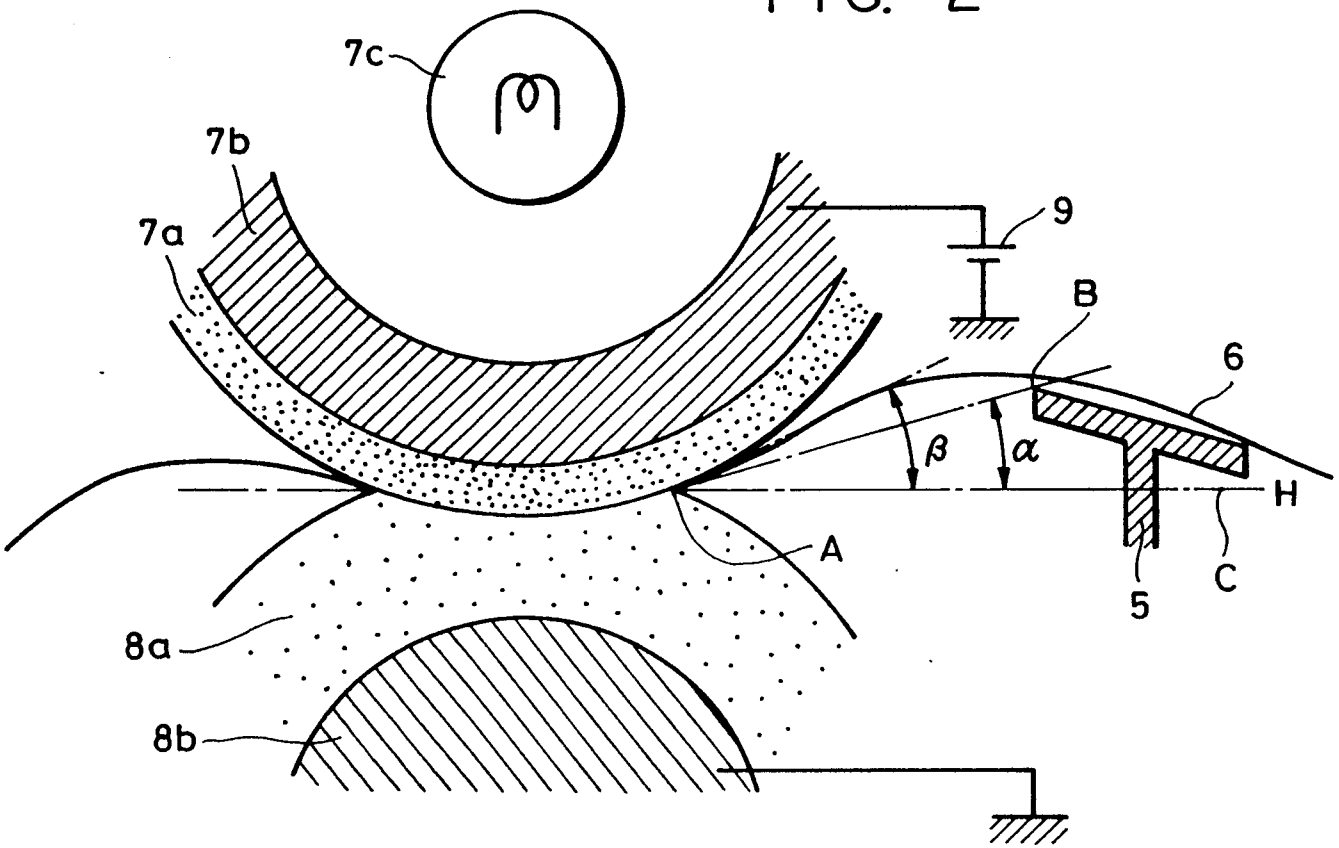
FIG. 2 is a cross-sectional view of a fixing device of the first embodiment.

FIG. 2 illustrates the configuration of the fixing device in more detail. The fixing roller 7 includes a halogen-lamp heater 7*c* arranged at its center and serving as the heating source. An offset preventing layer, that is, a surface releasing layer 7*a*, made by firing PTFE provided on the outer layer of an aluminum core bar 7*b*. A biasing power supply 9 is connected to the core bar 7*b*. The pressing roller 8 includes an elastic layer 8*a* provided on a core bar 8*b*, which is grounded. By applying a bias voltage having the same polarity as toner to the core bar 7*b*, the potential of the surface of the fixing roller 7 has the same polarity as the toner. As a result, the surface of the fixing roller 7 and the toner repel each other, thus preventing offset.

In such a fixing device, it has become clear that the effect of preventing electrostatic offset t the fixing roller, by applying a bias voltage, greatly depends on an angle of entrance of the recording material in the pressure-contact region. Particularly, a better result is obtained as the recording material enters the pressure-contact region from a side closer to the fixing roller, and further with contacting the fixing roller.

It can be considered that the above-described result is obtained for the following reasons. The surface of the fixing roller and the surface of the pressing roller generate triboelectric charges due to friction with the recording material. Since the intensity of the electric field between two charged substances is inversely proportional to the square of the distance between the substances, the recording material situated between the fixing roller and the pressing roller is more strongly influenced by the electric field produced by the roller closer to the recording material. Hence, when the recording material enters the pressure-contact region after bringing the recording material close to the fixing roller or contacting the recording material to the fixing roller, the recording material is strongly influenced by the electric field produced with the fixing roller. As a result, the bias voltage having the same polarity as the toner applied to the core bar effectively functions, increasing the effect of preventing electrostatic offset.

In consideration of the above-described fact in the first embodiment, by positioning the entrance guide 5 such that the angle of entrance of the recording material in the pressure-contact region is set to a preferred direction, offset can be prevented. That is, the entrance guide 6 is disposed at a position immediately before the entrance position of the recording material (a rightward position of the pressure-contact region in FIG. 2) in the pressure-contact region formed by the pressure contact of the fixing roller 7 and the pressing roller 8. Particularly, the entrance guide 5 is set so that a guide angle $\alpha$ ($\angle$ BAC), defined by point B (the upper-end position of the entrance guide 5 at the side of the fixing roller 7), point A (a point on the rear-end side of the Pressure-contact region formed by the fixing roller 7 and the pressing roller 8 in the direction of guiding the recording material) and point C (a point on a plane including the front-end side and the rear-end side of the pressure-contact region in the direction of guiding the recording material), has a positive value. (The value of the guide angle is assumed to be positive when straight line AB is above straight line AC. The same definition holds for the entrance angle $\beta$.)

In other words, the front-end point B of the guide unit in the direction of guiding the recording material is situated at the side of the fixing roller (the first rotating member) from the plane H including the front-end side and the rear-end side of the pressure-contact region in the direction of guiding the recording material.

By providing the entrance guide 5 at such a position, the entrance angle $\beta$ (the angle made by the recording material, point A and point C) in the pressure-contact region has a positive value even if a recording material having weak stiffness is used, thus effectively preventing offset.

When using a self-biasing means, such as a diode or the like, as a bias-voltage applying means, the surface of the fixing roller does not have a potential with the same polarity as the toner, unless friction is produced between the recording material and the fixing roller. That is, the effect of preventing offset cannot be obtained before the recording material contacts the fixing roller.

To the contrary, if a power supply is used as a bias-voltage applying means, the surface of the fixing roller is always maintained at a potential having the same polarity as toner. Hence, the effect of preventing offset is obtained even before the recording material contacts the fixing roller, thus providing a superior result. The pressing roller is not necessarily grounded, but instead may be ungrounded.

Figure 3:
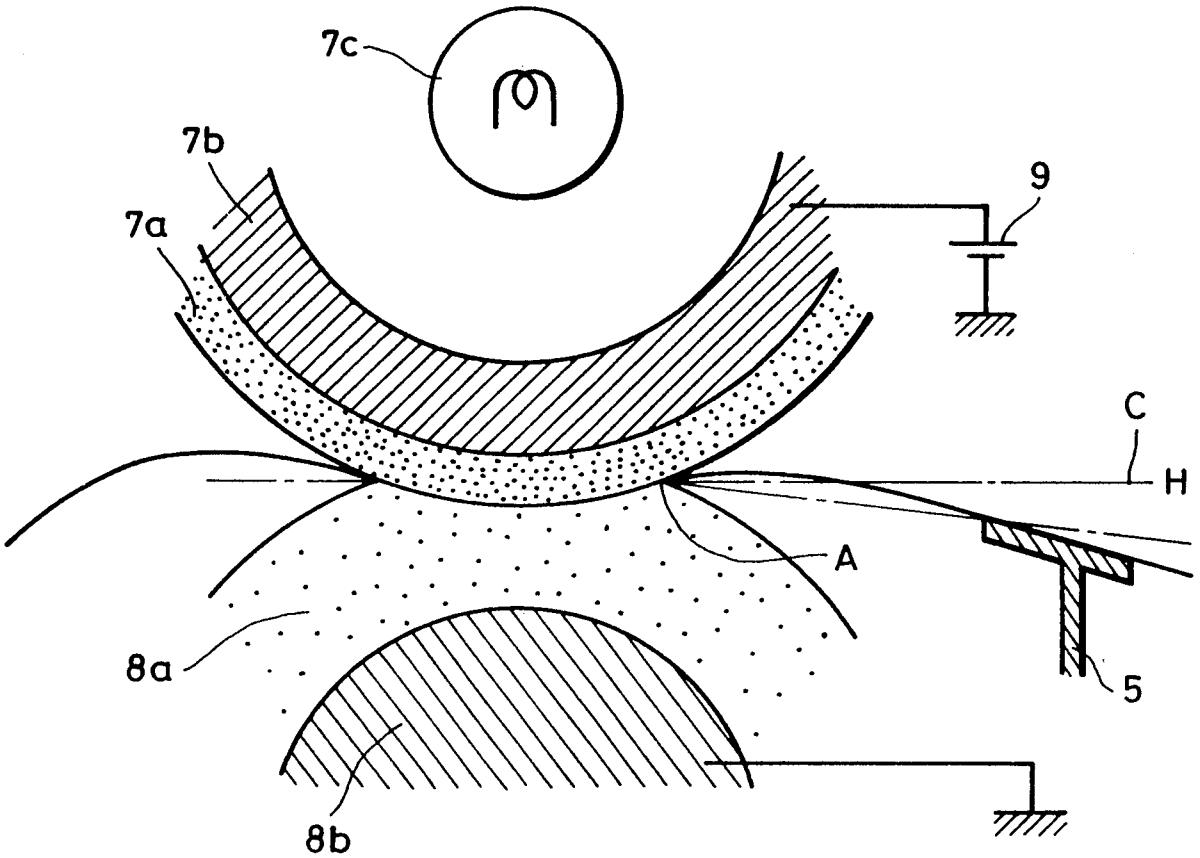
FIG. 3 is a cross-sectional view of a fixing device according to a second embodiment of the present invention.

As in a second embodiment shown in FIG. 3, when using a recording material having strong stiffness, even if the front end of the guide unit is disposed at the side of the pressing roller (the second rotating member) from the plane H including the front-end side and the rear-end side of the pressure-contact region in the direction of guiding the recording material, the recording material in some cases enters the pressure-contact region when approaching or contacting the fixing roller. However, the first embodiment is preferred when the recording material can enter the pressure-contact region while always approaching or contacting the pressure-contact region, even if various kinds of recording materials are used.

Table 1 shows the results of tests with respect to offset prevention of the fixing device according to the present embodiment.

TABLE 1

| | Effect of preventing offset in function of bias-voltage value of the fixing roller | | | | | |
|---|---|---|---|---|---|---|
| | Item | | | | | |
| Configuration | Guide angle$\alpha$ | Entrance angle$\beta$ | Bias-voltage value of the fixing roller (V) 0 | +300 | +500 | +1000 |
| Present embodiment | 30° | 33°-38° | x | ○ | ○ | ○ |
| | 15° | 18°-23° | x | Δ | ○ | ○ |
| | 0° | 3°-5° | x | x | Δ | ○ |
| Comparative example | −5° | −6°--7° | x | x | x | ○ |
| | −10° | −5°--9° | x | x | x | x |

Standard ○: Offset is not produced at all.
Δ: Offset is locally and slightly produced.

Evaluation method of offset

Ruled lines were copied on a half portion of the recording material at the front-end side in the direction of movement of the recording material, and evaluation was performed according to the presence of offset on the remaining half portion (white portion) at the rear-end side of the recording material.

-continued

| |
|---|
| x: Offset is entirely produced. |

From Table 1, it can be understood that an excellent effect of preventing offset was obtained over a wide range of bias-voltage values if the entrance angle $\beta$ is at least 3°. Particularly, an effect of preventing offset was obtained even at an applied voltage of about 300 V at a larger entrance angle $\beta$, providing a preferred result. In practice, if the bias-voltage value is at least 1 kV, leakage current is apt to occur between the fixing roller and the pressing roller. Hence, a bias-voltage value of less than 1 kV is preferred.

An effect of preventing offset was present at a bias-voltage value of 1 kV when the entrance angle is −6° to −7°. However, as described above, the bias-voltage value of 1 kV is not actually used. Accordingly, it can be understood that an effect of preventing offset is not obtained even if a bias voltage is applied to the core bar of the fixing roller when the entrance angle has a negative value.

Figure 4:
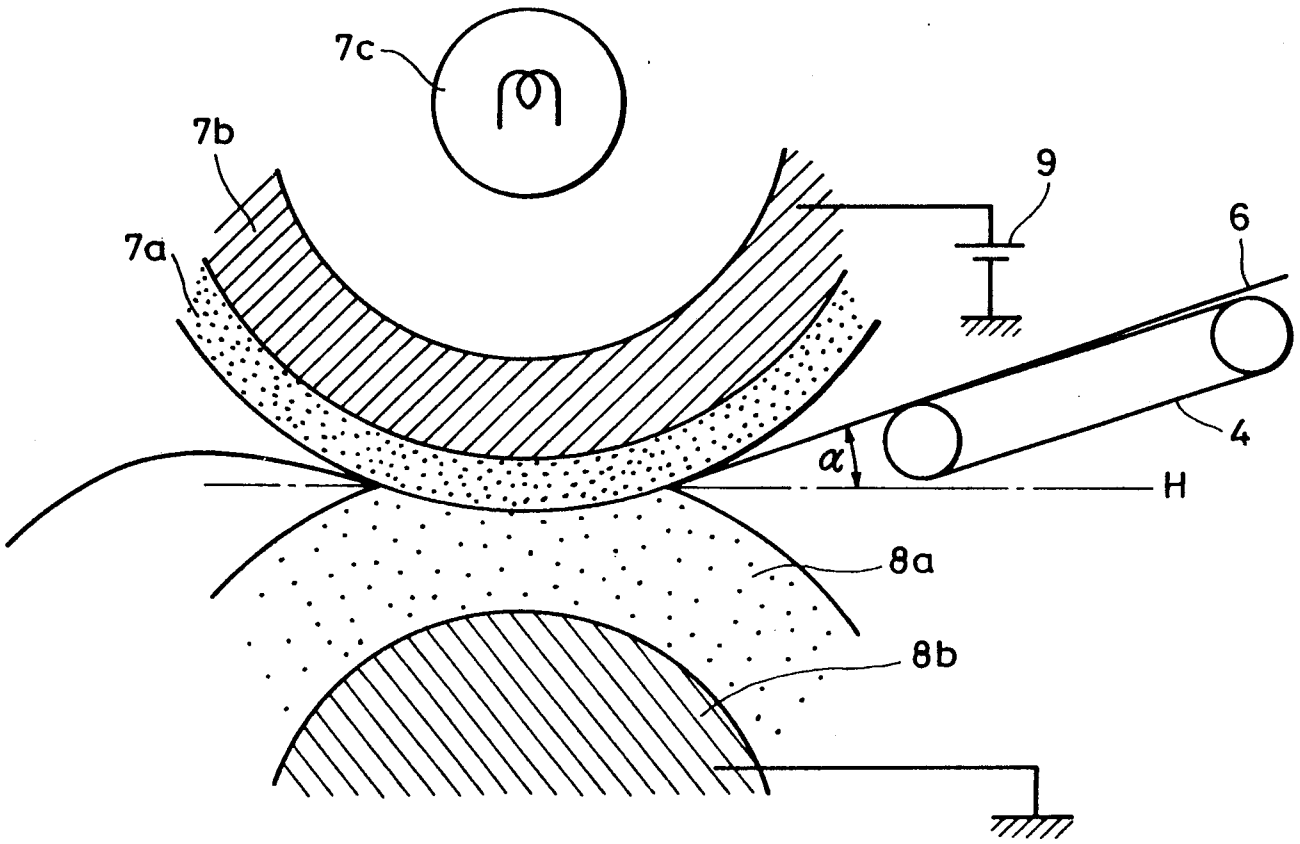
FIG. 4 is a cross-sectional view of a fixing device and a belt-like conveying unit according to a third embodiment of the present invention.

FIG. 4 shows a third embodiment of the present invention.

The present embodiment has a feature in that the guide angle $\alpha$ is made to be greater than 0° by means of a belt-type conveying unit 4, such that the entrance angle $\beta$ also becomes greater than 0°.

Also in the present fixing device, the result of the same test of the generation of offset with applying a fixing bias voltage of +500 (V) indicates that an excellent effect of preventing offset was obtained.

Figure 5:
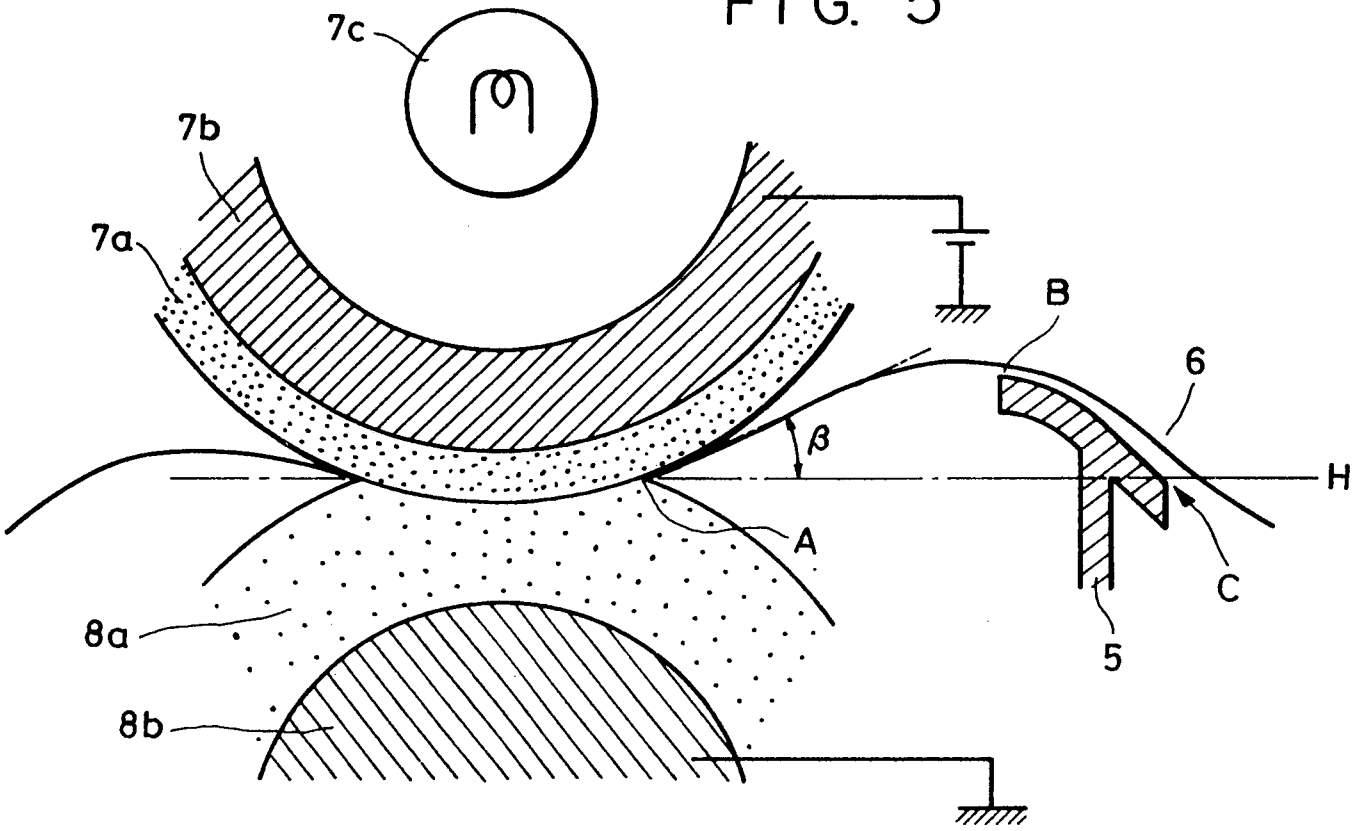
FIG. 5 is a cross-sectional view of a fixing device according to a fourth embodiment of the present invention.

FIG. 5 shows a fourth embodiment of the present invention. In the present embodiment, the shape of the entrance guide 5 is changed so that the guide unit has a curved surface. The entrance angle $\beta$ is set to be greater than 0°. Also in this case, an excellent effect of preventing offset was obtained.

Figure 6:
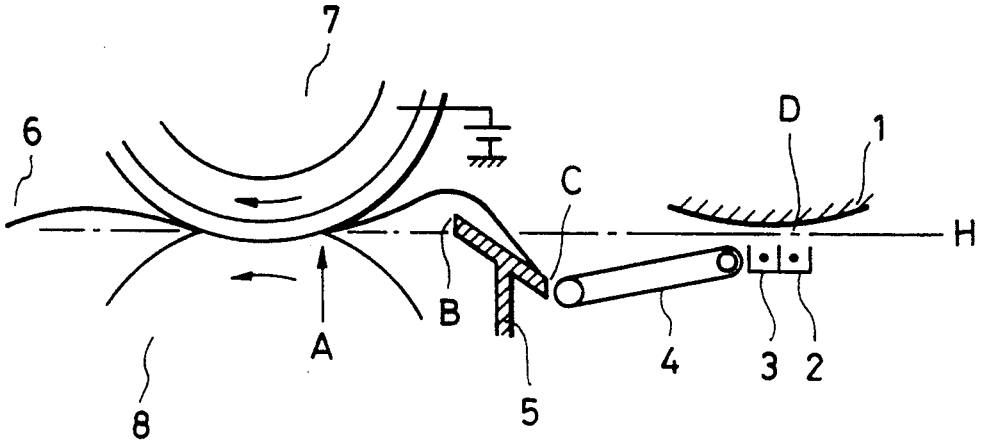
FIG. 6 is a cross-sectional view of an image forming apparatus according to a fifth embodiment of the present invention.

FIG. 6 shows a fifth embodiment of the present invention. In the present embodiment, the setting position of the fixing entrance guide 5 is the same as in the first embodiment. In addition, the conveying belt (recording-material conveying path) 4, situated between the guide 5 and the transfer charging unit 2, for conveying the recording material 6 to the guide 5 is disposed so as to be convex at the side of the pressing roller 8. Furthermore, the distance between the pressure-contact region and the transfer region is smaller than the maximum size of recording paper usable in the present image forming apparatus.

By adopting such a configuration, when a recording material having the maximum size is conveyed from the transfer region to the pressure-contact region, a force for moving the recording material in a direction perpendicular to the plane H is exerted on the recording material, since the recording material is longer than the distance between the pressure-contact region and the transfer region. Hence, the recording material 6 is apt to rise to the side of the fixing roller 7 in the neighborhood of the fixing roller 7 along the guide 5. As a result, the recording material 6 comes closer to the side of the fixing roller 7 than when the front end B of the guide 6 is merely protruded to the side of the fixing roller 7 from the plane H, increasing the effect of preventing electrostatic offset.

Figure 7:
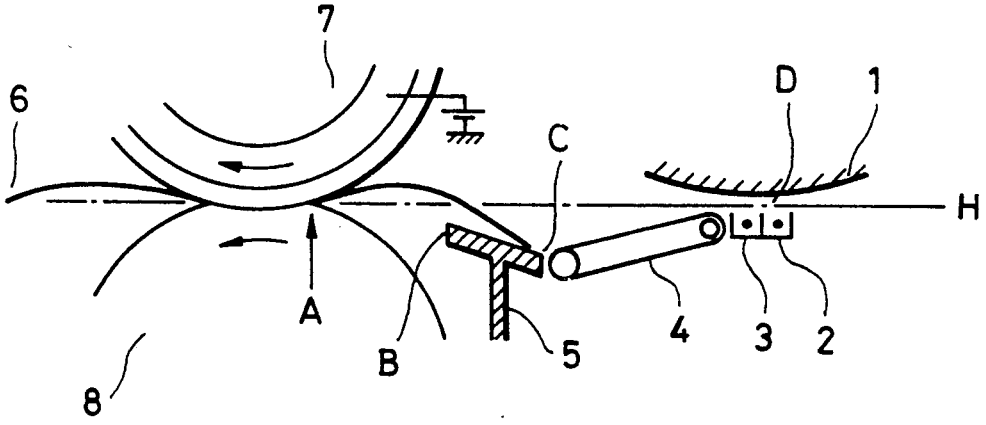
FIG. 7 is a cross-sectional view of an image forming apparatus according to a sixth embodiment of the present invention.

FIG. 7 shows a sixth embodiment of the present invention. In the present embodiment, the front end B of the guide 5 is disposed at the side of the pressing roller 8 from the plane H, and the conveying belt 4 is disposed so as to be convex to the side of the pressing roller 8. By adopting such a configuration, the recording material is apt to rise to the side of the fixing roller 7. As a result, if a bias voltage having the same polarity as the toner is applied to the core bar, the recording material enters the contact-pressure region after approaching or contacting the fixing roller 7. Hence, offset is effectively prevented.

However, when using a recording material having weak stiffness, the recording material in some cases enters the contact-pressure region when approaching or contacting the pressing roller 8. Hence, the front end B of the guide 5 is preferred to be at the side of the fixing roller 7 from the plane H.

As explained above, in the present invention, a bias voltage having the same polarity as the toner is applied to the core bar of the fixing roller, and the recording material enters the pressure-contact region after approaching or contacting the fixing roller. Accordingly, it becomes possible to sufficiently provide the effect of preventing electrostatic offset of toner by applying a bias voltage, and thus forming an excellent image.

While, in all of the above-described six embodiments, a bias voltage is applied only to the fixing roller, the present invention is not limited to such a case, but includes a case when a bias voltage is applied only to the pressing roller.

The present invention is not limited to the above-described embodiments, but includes any other changes and modifications as fall within the true spirit and scope of the invention.

What is claimed is:

1. An image fixing apparatus, comprising:

a pair of rotatable members forming a pressure-contact region having two ends;

bias application means for applying a bias voltage to one of said pair of rotatable members; and guide means for guiding a recording material bearing a toner image to the pressure-contact region, wherein an end portion of said guide means in the downstream of a direction of movement of the recording material is arranged on a side of said one rotatable member applied with the bias voltage with respect to a plane passing through the two ends of the pressure-contact region.

2. An image fixing apparatus according to claim 1, wherein said bias application means comprises a power supply.

3. An image fixing apparatus according to claim 1, wherein, when said one rotatable member applied with said bias voltage is in contact with an unfixed toner image, the bias voltage has the same polarity as a charging polarity of toner.

4. An image fixing apparatus according to claim 1, wherein said one rotatable member applied with the bias voltage applied with the bias voltage comprises a conductive base member, said base member being applied with the bias voltage.

5. An image fixing apparatus according to claim 1, wherein the end portion of said guide means in the downstream direction of the direction of movement of the recording material is arranged in proximity to said one rotatable member applied with said bias voltage.

6. An image fixing apparatus according to claim 1, wherein said guide means intersects the plane.

7. An image fixing apparatus according to claim 1, wherein the other one of said pair of rotating members is grounded.

8. An image forming apparatus according to claim 1, wherein said one rotatable member applied with the bias voltage is electrically floated.

9. An image forming apparatus comprising:

an image fixing apparatus comprising:

a pair of rotatable members forming a pressure-contact region having two ends, bias application means for applying a bias voltage to one of said pair of rotatable members, and guide means for guiding a recording material bearing a toner image to the pressure-contact region, wherein an end portion of said guide means in the downstream of a direction of movement of the recording material is arranged on a side of said one rotatable member applied with the bias voltage with respect to a plane passing through the two ends of the pressure-contact region;

an image bearing member;

transfer means for transferring an unfixed toner image formed on said image bearing member to a recording material; and a recording material conveying path disposed between said transfer means and said guide means and arranged in a concave orientation with respect to the side of said one rotating member applied with the bias voltage.

10. An image forming apparatus according to claim 9, wherein a distance between the pressure-contact region and the transfer region is smaller than the maximum size of the recording material.

11. An image forming apparatus for forming an unfixed toner image on a recording material, comprising, fixing means for fixing the recording material bearing the unfixed toner image, said fixing means comprising;

a first rotating member having a conductive base member and a surface releasing first layer and contacting the unfixed toner image, said first rotating member defining a first longitudinal axis;

a second rotating member in pressure contact with said first rotating member at a pressure contact region, said second rotating member defining a second longitudinal axis, wherein the first and second longitudinal axes of said first and second rotating members define a first plane which passes through the pressure-contact region, wherein a second plane is defined as being substantially perpendicular to the first plane and which passes through the pressure-contact region; and a power supply for applying a bias voltage to said conductive base member; and a guide unit for guiding said recording material in a guiding direction to the pressure-contact region, wherein said guide unit has first and second portions, wherein the first portion is closer to the first plane than the second portion, wherein the first portion is on the same side of the second plane as said first rotating member and wherein the guiding direction defines an angle $\beta$ with respect to the second plane, such that $0° < \beta < 90°$.

12. An image forming apparatus according to claim 11, wherein the bias voltage has the same polarity as a charging polarity of toner.

13. An image forming apparatus according to claim 11, wherein the first portion of said guide unit is arranged in proximity to said first rotating member.

14. An image forming apparatus according to claim 11, further comprising a recording-material conveying path for conveying the recording material to said guide unit, the recording material being conveyed from the side of the second rotating member at the second plane to said guide unit.

15. An image forming apparatus according to claim 14, further comprising:

an image bearing member; and transfer means for transferring the unfixed toner image formed on said image bearing member to the recording material at a transfer region, wherein said recording material conveying path is disposed between said transfer means and said guide unit and is arranged in a convex orientation with respect to the side of said second rotating member.

16. An image forming apparatus according to claim 15, wherein a distance between the pressure-contact region and the transfer region is smaller than the maximum size of the recording material.

17. An image forming apparatus according to claim 11, wherein the value of said bias voltage is at most 1 kV.

18. An image forming apparatus according to claim 11, wherein said second rotating member is grounded.

19. An image forming apparatus according to claim 11, wherein said second rotating member is ungrounded.

20. A fixing device for fixing a toner image on a recording material, comprising:

a pair of rotatable members forming a pressure-contact region; and bias application means for applying a bias voltage to one of said pair of rotatable members;

wherein said recording material enters the pressure-contact region after contacting with said one rotating member applied with the bias voltage.

21. A fixing device according to claim 20, wherein said bias application means comprises a power supply.

22. A fixing device according to claim 20, wherein, when said one rotatable member applied with the bias voltage is in contact with an unfixed toner image, the bias voltage has the same polarity as a charging polarity of toner.

23. An image forming apparatus according to claim 20, wherein said one rotatable member applied with the bias voltage comprises a conductive base member, said base member being applied with the bias voltage.

24. A fixing device according to claim 20, wherein the recording-material enters to the pressure-contact region around the surface of the rotatable member applied with the bias voltage.

25. A fixing device according to claim 20, wherein said bias application means comprises an electrical power source for applying the bias voltage.

26. An image forming apparatus for forming a toner image on a recording material, comprising:

an image fixing apparatus comprising:

a pair of rotatable members forming a pressure-contact region having two ends, bias application means for applying a bias voltage to one of said pair of rotatable members, and guide means for guiding the recording material bearing the toner image to the pressure-contact region, wherein an end portion of said guide means in the downstream of a direction of movement of the recording material is arranged on a side of said one rotatable member applied with the bias voltage with respect to a plane passing through the two ends of the pressure-contact region.

27. An image forming device according to claim 26, wherein the end portion of said guide means in the downstream of the direction of movement of the recording material is arranged on the side of the rotatable member applied with said bias voltage than a plane including both ends of said pressure-contact region.

28. An image forming apparatus according to claim 26, wherein an angle formed by a line, connecting between the end of said guide means and the pressure-contact region, and the plane, is greater than 0°.

29. An image forming apparatus according to claim 26, wherein the recording material intersects the plane and is conveyed by the rotatable member applied with said bias voltage.

30. An image forming apparatus according to claim 26, wherein the other of said pair of rotating members is grounded.

31. An image forming apparatus according to claim 26, wherein said rotatable member applied with the bias voltage is electrically floated.

* * * * *

UNITED STATES PATENT AND TRADEMARK OFFICE

CERTIFICATE OF CORRECTION

PATENT NO. : 5,159,394

DATED : October 27, 1992

INVENTOR(S) : Jinzai

It is certified that error appears in the above-identified patent and that said Letters Patent is hereby corrected as shown below:

COLUMN 2

Line 55, "1 aye r" should read --layer--; and
Line 55, ", u sing" should read --, using--.

COLUMN 3

Line 18, "t" should read --to--;
Line 49, "guide 6" should read --guide 5--; and
Line 57, "Pressure" should read --pressure--.

COLUMN 5

Line 62, "guide 6" should read --guide 5--.

COLUMN 6

Line 58, "applied with the bias voltage" should be deleted.

COLUMN 7

Line 4, "forming" should read --fixing--; and
Line 39, "ing;" should read --ing:--.

UNITED STATES PATENT AND TRADEMARK OFFICE

CERTIFICATE OF CORRECTION

PATENT NO. : 5,159,394

DATED : October 27, 1992

INVENTOR(S) : Jinzai

It is certified that error appears in the above-identified patent and that said Letters Patent is hereby corrected as shown below:

COLUMN 8

Line 49, "An image forming apparatus" should read --A fixng device--;

Line 54, "recording-material" should read --recording material--.

COLUMN 9

Line 9, "device" should read --apparatus--.

Signed and Sealed this

Fourteenth Day of December, 1993

Bruce Lehman

*Attest:*

BRUCE LEHMAN

*Attesting Officer*

*Commissioner of Patents and Trademarks*